US005850775A

United States Patent [19]

Stiefel

[11] Patent Number: 5,850,775

[45] Date of Patent: Dec. 22, 1998

[54] PUMP PISTON

[75] Inventor: Hans-Peter Stiefel, Ditzingen, Germany

[73] Assignee: Robert Bosch GmbH, Stuttgart, Germany

[21] Appl. No.: 670,470

[22] Filed: Jun. 26, 1996

[30] Foreign Application Priority Data

Jun. 27, 1996 [DE] Germany ..... 195 23 282.8

[51] Int. Cl.[6] ..... F01B 3/02

[52] U.S. Cl. ..... 92/12.2; 91/506; 74/839

[58] Field of Search ..... 91/505, 506; 92/12.2; 74/839; 417/222.1

[56] References Cited

U.S. PATENT DOCUMENTS

| | | | |
|---|---|---|---|
| Re. 32,373 | 3/1987 | Bobier . | |
| 2,040,390 | 5/1936 | Loe . | |
| 3,077,118 | 2/1963 | Robbins | 92/12.2 |
| 3,486,454 | 12/1969 | Tuzson . | |
| 4,149,830 | 4/1979 | Woodruff | 417/222.1 |
| 4,433,596 | 2/1984 | Scalzo | 92/12.2 |

FOREIGN PATENT DOCUMENTS

| | | | |
|---|---|---|---|
| 0095992 | 12/1983 | European Pat. Off. . | |
| 0254579 | 1/1988 | European Pat. Off. . | |
| 162782 | 9/1983 | Japan | 92/12.2 |
| 561893 | 6/1944 | United Kingdom . | |
| 646504 | 11/1950 | United Kingdom . | |
| 2004587 | 4/1979 | United Kingdom . | |
| 1568946 | 6/1980 | United Kingdom . | |
| 3308507 | 9/1984 | United Kingdom . | |

*Primary Examiner*—F. Daniel Lopez
*Attorney, Agent, or Firm*—Edwin E. Greigg; Ronald E. Greigg

[57] ABSTRACT

The invention relates to an axial piston pump with at least one pump element, which includes a piston disposed in a housing, with a drive shaft upon which a swash plate for driving the piston is disposed. The swash plate is non-rotatably fixed, but can pivot around a swash plate pivot axis which extends perpendicular to the longitudinal drive shaft axis (A), and with a device for adjusting a pivot angle between the drive shaft and the swash plate. In order to be able to adjust the oblique position of the swash plate in a simple manner, even during pump operation, it is provided that the device for adjusting the pivot angle of the swash plate has a displacing device disposed in a stationary manner on the housing. The displacing device acts on the swash plate via an intermediate member, which rotates jointly with it, on one end of the swash plate pivot axis to adjust pivot angle of the swash plate in the axial direction of the drive shaft so that the swash plate is secured in the adjusted pivot position when the drive shaft rotates.

14 Claims, 3 Drawing Sheets

PUMP PISTON

BACKGROUND OF THE INVENTION

The invention relates to a piston pump for use with an engine.

Piston pumps of this kind, which have one or more pump elements, which are disposed in a stationary manner in a housing and contain a piston, belong to the general prior art (Reprint of a lecture entitled "Grundlagen der Ölhydraulik" ["The Basics of Oil Hydraulics"], by Prof. Dr.-Ing. W. Backé of the Institut für hydraulische und pneumatische Antriebe und Steuerungen [Institute for Hydraulic and Pneumatic Drives and Controls], RWTH Aachen, 4th Edition, 1979, p. 120) and contain a swash plate, which is non-rotatably disposed on a drive shaft and acts upon the pump element so that the pistons of the pump elements axially oscillate when the swash plate rotates. In order to adjust the volumetric displacement of the pump, the swash plate is disposed on the drive shaft so that it can pivot around a pivot axis which runs perpendicular to the longitudinal axis of the drive shaft.

There is the problem that the swash plate rotates during pump operation, as a result of which considerable difficulties arise if the pivot angle of the swash plate needs to be changed.

That is why swash plate pumps or oblique drum pumps are normally preferable if an adjustment of the volumetric displacement is supposed to be possible.

Swash plate pumps have a non-rotating actuating disk for the pistons, which is disposed in a housing, oblique to the rotation axis of a drum, which has the pump elements and rotates during pump operation, so that the angle between the actuating disk and the rotation axis can be adjusted by means of an adjusting device. Doing this is disadvantageous in that relatively large masses must be moved during pump operation.

Oblique drum pumps have a rotating drum, which contains pump elements and can be pivoted in relation to a stationary piston actuating disk in order to adjust the volumetric displacement. With this kind of pump, not only must relatively large masses be moved during pump operation, but the inlet and return lines for the medium to be delivered must also be embodied flexibly, to prevent them from hindering an oblique motion of the drum.

OBJECT AND SUMMARY OF THE INVENTION

The piston pump has the advantage over the prior art that the oblique position of the swash plate can be easily adjusted, even during pump operation, so that the volumetric displacement can be smoothly adapted in a simple manner to the respective operating requirements, that is, to different volumetric displacements for example, without having to move a relatively heavy drum with the pump elements during pump operation. The axial piston pump according to the invention has a small structural volume and a simple design; in particular, the lines for connecting the pump do not have to be elastic.

The invention will be better understood and further objects and advantages thereof will become more apparent from the ensuing detailed description of a preferred embodiment taken in conjunction with the drawings.

DETAILED DESCRIPTION OF THE PREFERRED EMBODIMENT

Figure 1:
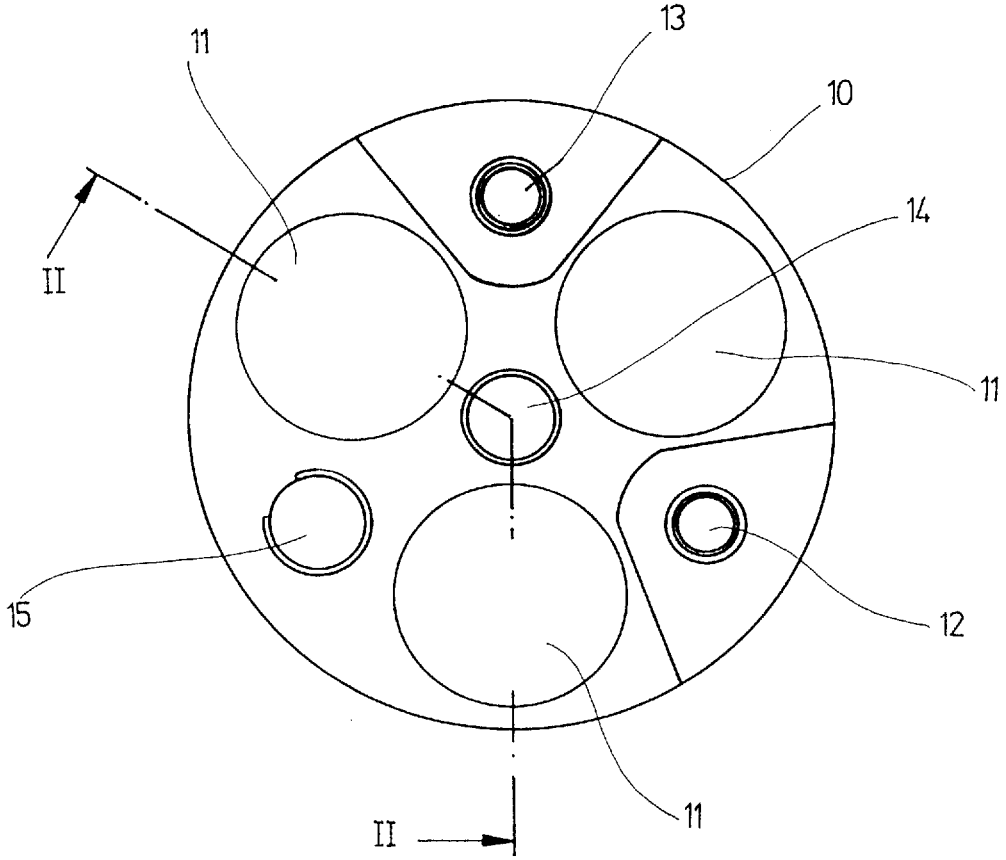
FIG. 1 shows a schematic top view of an end face of an axial piston pump according to an exemplary embodiment of the invention.

In the various figures of the drawings, corresponding components are provided with the same reference numerals.

As shown in FIG. 1, a piston pump, which is preferably embodied as an axial piston pump, has three pump elements 11 disposed in a stationary manner in a housing 10. An inlet connection 12 and a return connection 13 are used to connect the axial piston pump to a reservoir, not shown, for a fluid to be delivered, for example for connecting to a fuel receptacle. A high pressure connection 14 is provided, which communicates with a high pressure region of the axial piston pump, in order to withdraw pressurized fluid in the usual manner. In a manner now shown in detail, a pre-stressed check valve 15 connects the high pressure region to a low pressure region in order to achieve a pressure limitation.

Figure 2:
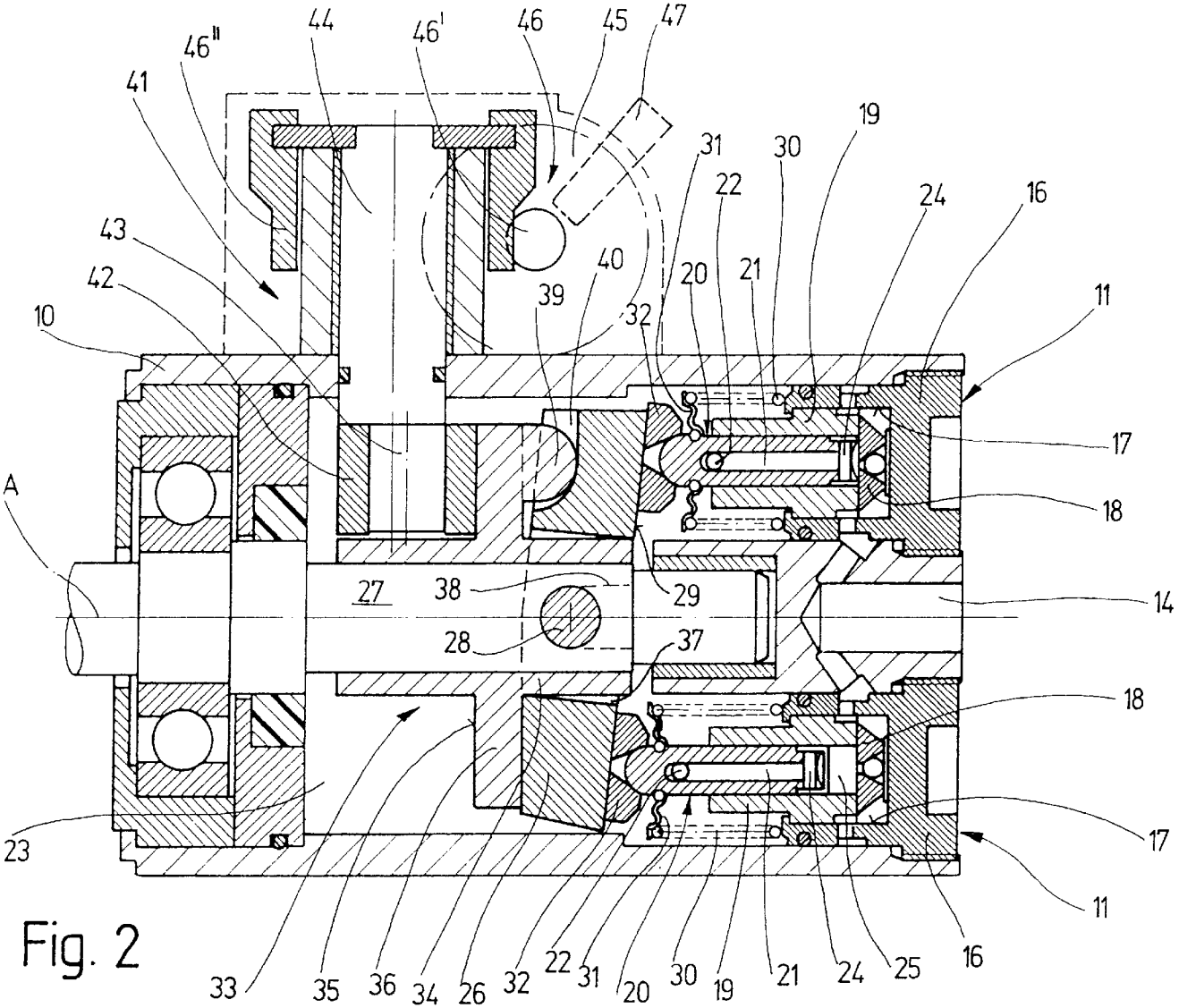
FIG. 2 shows a section through an axial piston pump according to the invention, essentially according to line II—II in FIG. 1, when the maximal feed stroke is set.

As shown in FIG. 2, each of the pump elements 11 disposed in the housing 10 includes a retaining element 16, which is inserted into the housing 10 and fastened in the housing and which has a recess 17 in which a valve 18 and a pump cylinder 19 are firmly inserted. A piston 20 is movably contained in the cylinder chamber of the pump cylinder 19.

Each piston 20 has an inlet bore 21, which extends in the longitudinal direction of the piston and on its end to the left in the drawing, communicates via a lateral bore 22 with the low pressure region 23 of the axial piston pump and is associated with an inlet valve 24 on the end of the piston 20 disposed in the cylinder chamber.

During the intake stroke of the piston 20, the inlet valve 24 allows a communication between the low pressure region 23 and a compression chamber 25, which is defined in the cylinder chamber by the piston 20, whereas during the compression stroke, the valve closes this communication. Accordingly, the valve 18 allows communication between the compression chamber 25 and the high pressure region during the compression stroke of the piston 20, whereas during the intake stroke, the valve closes this communication.

In order to drive the pistons 20, a swash plate 26 is provided, which is non-rotatably secured on a drive shaft 27, which is rotatably supported in the housing 10 by means of a driving pin 28 which is preferably disposed perpendicular to the longitudinal drive shaft axis A, but can be pivoted around a swash plate pivot axis established by the driving pin 28. The longitudinal axes of the pistons 20 are suitably disposed parallel to the longitudinal drive shaft axis A.

The pivot axis of the swash plate 26, though, can also be inclined by a particular angle in relation to the longitudinal drive shaft axis A and/or can be a little offset radially toward the outside in relation to the longitudinal drive shaft axis A.

Oriented toward the piston 20, the swash plate 26 has a slide face 29, against which the pistons 20 are pressed by springs 30, which are respectively supported between the corresponding retaining element 16 and a spring plate 31 attached to the free end of the piston 20. Guide shoes 32 are disposed between the free ends of the pistons 20 and the slide face 29, which shoes assure a trouble-free sliding motion of the pistons 20 on the slide face 29 of the swash plate 26 during pump operation, and thereby prevent pistons 20 from jamming in the pump cylinder 19.

In lieu of the described pump elements 11, other conventional pump elements can also be provided. The pistons 20 can also be movably supported in a piston guide bore provided directly in the housing. In an embodiment of this kind, therefore, the pump element 11 shown in the drawing with the retaining element 16 and the pump cylinder 19 can be omitted. It is possible to equip the piston pump with a single piston 20 or a single pump element 11. In order to keep pressure pulsations as small as possible, several pistons 20 or pump elements 11 are provided, for example, an odd number of them, preferably three.

A device for adjusting a pivot angle between the drive shaft 27 and the swash plate 26 has an intermediate member 33, which is disposed on the drive shaft 27 so that the swash plate is non-rotatable and can be axially moved, which intermediate member is used as a stroke adjusting element or stroke transmitting element and has a sleeve section 34 and a disk-shaped section 36, which carries an annular face 35 perpendicular to the drive shaft 27. The sleeve section 34 extends from the disk-shaped section 36 in the longitudinal direction of the drive shaft into a central recess 37 of the swash plate 26 and contains two longitudinal slots 38 (see FIG. 3 in particular), which run in the longitudinal direction of the drive shaft and are diametrically opposed to each other in relation to the drive shaft 27, through which slots the driving pin 28 extends in order to fix the intermediate member 33 non-rotatably on the drive shaft 27.

The intermediate member 33 and the swash plate 36 rotate jointly. In the exemplary embodiment shown, the torque is transmitted by the drive shaft 27 onto the intermediate part 33. It is, however, also possible to modify the piston pump so that the intermediate member 33 is driven via the swash plate 26.

The non-rotatable disposition of the intermediate member 33 on the drive shaft 27 can also be achieved for example by means of a wedge/groove connection or the like.

The annular face 35 on the disk-shaped section 36 of the intermediate member 33 is disposed on the side remote from the swash plate 26 and extends completely around the drive shaft 27. On the side oriented toward the swash plate 26, an axially directed projection 39 is provided, which engages in a recess 40 in the swash plate 26. Alternatively to this, the projection can also be provided on the swash plate 26 and engage in a recess on the intermediate member 33. With a corresponding embodiment of the intermediate member 33 and the swash plate 26, the recess 40 in the swash plate 26 or in the intermediate member 33 can be omitted.

For example, it is also possible to provide a gearing on the intermediate member 33 which engages a corresponding gearing on the swash plate 26 in such a way that when the intermediate member 33 is moved in the direction of the drive shaft axis A, the pivot angle of the swash plate 26 changes.

In order to be able to move the intermediate member 33 in the direction of the drive shaft axis A to adjust the pivot angle of the swash plate 26, a displacing device 41 is provided, which is preferably disposed in a stationary manner on the housing 10 and which, with a thrust part 43, rests against the annular face 35 via a slide element 42. The slide element 42 is preferably fastened on the thrust part 43 so that it can move, but could also be disposed on the annular face 35. If need be, the slide element 42 can be completely omitted. For example, the slide element 42 can also be replaced by a rolling bearing.

The thrust part 43 is embodied on an eccentric shaft 44, which runs lateral to the drive shaft 27 and is disposed on the housing 10 so that it can rotate around its own longitudinal axis, which thrust part is embodied as a continuation which is offset in relation to this longitudinal axis and can be adjusted in the direction of the drive shaft axis A when the eccentric shaft 44 is rotated. The axial position of the intermediate member 33 in relation to the swash plate pivot axis can be adjusted with the thrust part 43 and can be secured when the drive shaft 27 is rotating in order to thus adjust the pivot angle of the swash plate 26 and fix it during pump operation.

In order to adjust the thrust part 43 in the longitudinal direction of the drive shaft 27, the eccentric shaft 44 can be rotated around its longitudinal axis by an actuating drive 45, in particular by an electric motor. The actuating drive 45 acts upon the eccentric shaft 44 and therefore also the thrust part 43 via a gear device 46, which can be, for example, a worm gear and with a worm 46' driven by the actuating drive 45 and a worm wheel 46", which is connected to the eccentric shaft 44.

In a suitable manner, a sensor 47 is provided, which detects the number of rotations of the actuating drive 45 and whose output signal is supplied to a control device (not shown), which acts upon the actuating drive 45, in order to determine and control an adjustment of the axial position of the intermediate member 33.

Because of the possible association between the rotation of the worm 46' and the position of the intermediate member 33 (viewed in the longitudinal direction of the drive shaft 27), the rotations of the worm 46' can be used as a measure for the position of the intermediate member 33. The gear device 46 is used for a speed reduction and a torque increase in the transmission of the actuating movement of the actuating drive 45 into the actuating movement (in the axial direction) of the intermediate member 33. Because of the gear device 46, it is possible with the sensor 47 to obtain for example only the number of rotations of the worm 46' and in spite of this, to obtain very precise information about the position of the intermediate member 33 and thus about the current pivot angle of the swash plate 26, which is a measure for the respectively adjusted feed stroke.

In particular with a large piston pump, the gear device 46 also allows the use of a relatively small and weak actuating drive 45, for example a small, low-torque electric motor.

Now, the adjustment of the delivery capacity of the described axial piston pump will be described with regard to FIGS. 2 and 3.

In FIG. 2, the thrust part 43 is shown in its position in which it is moved the furthest toward the swash plate 26, in which position the greatest adjustable pivot angle of the swash plate 26 and thereby the greatest adjustable piston stroke is achieved. In this connection, the swash plate 26, which is embodied as wedge-shaped, is disposed with its region remote from the recess 40 resting against the disk-shaped section 36 of the intermediate member 33.

In order to reduce the delivery capacity of the axial piston pump according to the invention, the eccentric shaft 44 is rotated by the actuating drive 45 so that the thrust part 43 moves away from the swash plate 26.

Figure 3:
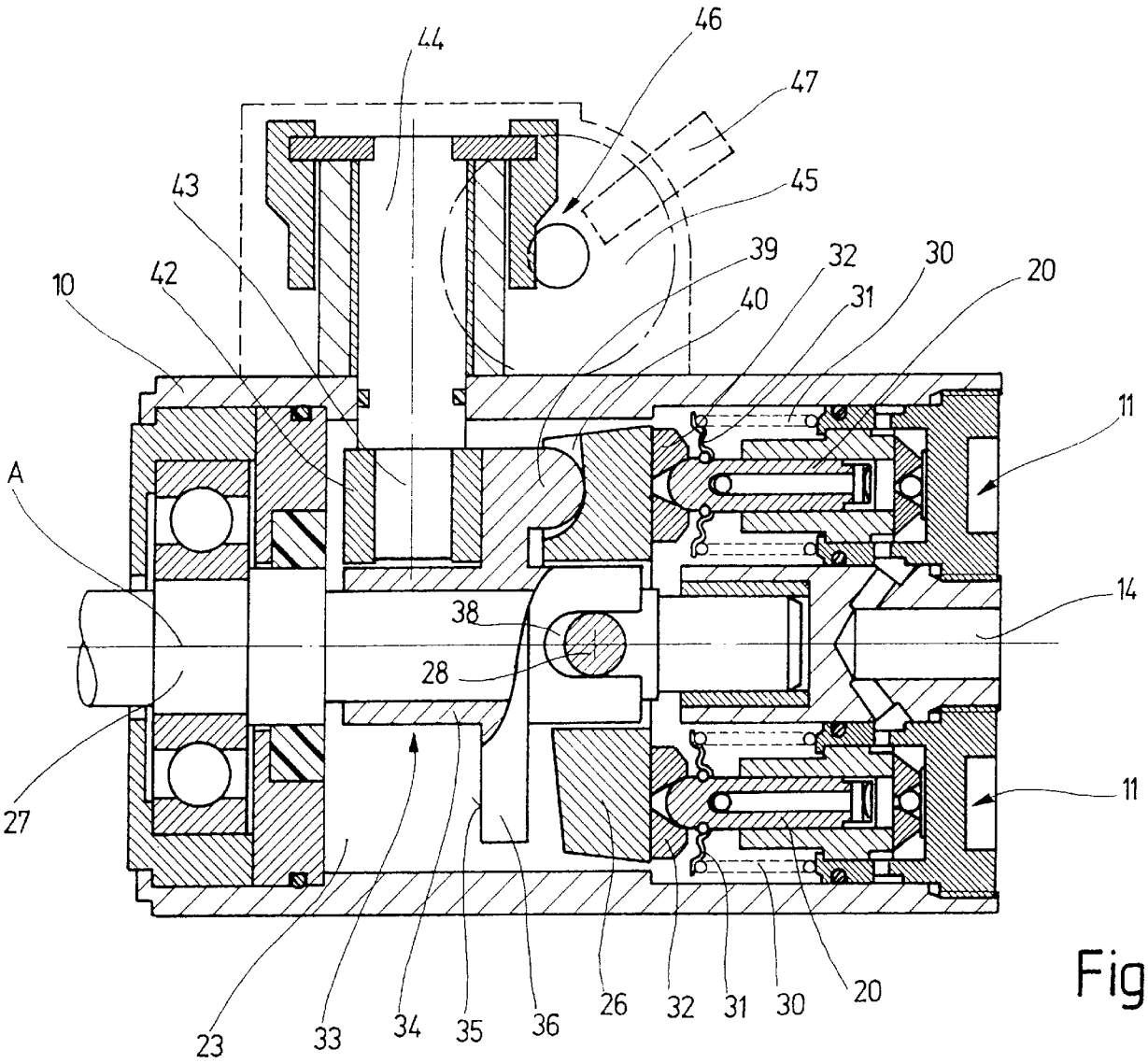
FIG. 3 shows a section through an axial piston pump according to the invention, likewise essentially according to line II—II in FIG. 1, when the feed stroke is set at zero.

Since the swash plate 26 is secured pressed against the projection 39 on the intermediate member 33 by the piston 20, which is acted upon by a spring, as a result, the intermediate member 33 is secured pressed against the thrust part 43 of the displacing device 41 and therefore follows the axial movement of the thrust part 43 until this assumes for example the position shown in FIG. 3, in which position the swash plate 26 is perpendicular to the drive shaft 27 and because of this, carries out no further piston stroke. Here, the delivery capacity is zero. The swash plate 26 is thus rotated around the driving pin 28 in accordance with a movement of the thrust part 43 so that the oblique position of the swash plate 26 is achieved, which is required for the desired pump motion of the pistons 20.

With the device according to the invention for adjusting the pivot angle of the swash plate 26, therefore, the piston stroke and as a result, the delivery capacity of the axial piston pump can be smoothly adjusted between a greatest value and zero. In the exemplary embodiment described, if an actuating drive is used, in particular a controllable electrical motor, then even during the operation of the axial piston pump, the delivery capacity can be changed without requiring an interruption of operation.

The displacing device 41 can also be constructed in some other suitable manner in order to carry out an adjustment of the pivot angle of the swash plate 26. For example, the adjusting device can also have a tappet, which is disposed parallel to the drive shaft and which for example is moved directly by a linear actuating drive in the direction of the drive shaft axis A in order to carry out a desired movement of the intermediate member.

Furthermore, it is possible to embody the thrust part as an annular cylinder which encompasses the drive shaft with spacing, which cylinder can be moved in the direction of the drive shaft axis A and which, with an annular end face oriented toward the swash plate 26, acts upon an intermediate member which is attached to the swash plate 26 and protrudes from it, in order to bring about a change of the pivot position of the swash plate 26.

Another possibility consists of providing an annular face, which is the shape of a truncated cone, on the intermediate member and employing a wedge, which can be moved lateral to the drive shaft axis as a thrust part.

For example, an actuating cylinder, which can be changed in length, can be used as a displacing device, which cylinder is supported on one of its ends against the housing and is supported on its other end against the intermediate member 33. In order to prevent the actuating cylinder from tilting away, this cylinder can, for example, be guided in a corresponding bore provided in the housing 10.

The foregoing relates to a preferred exemplary embodiment of the invention, it being understood that other variants and embodiments thereof are possible within the spirit and scope of the invention, the latter being defined by the appended claims.

What is claimed and desired to be secured by Letters Patent of the United States is:

1. A piston pump with at least one piston (20) supported so that the piston moves in a housing (10), a drive shaft (27), upon which a swash plate (26) for driving the piston (20) is non-rotatably disposed, said swash plate pivots around a swash plate pivot axis, and with a device for adjusting a pivot angle between the drive shaft (27) and the swash plate (26), the device for adjusting the pivot angle of the swash plate (26) has a displacing device (41) disposed on the housing (10), said displacing device acts upon the swash plate (26) via a rotating intermediate member (33) for adjusting the pivot angle, the swash plate (26) is pivotably secured on a driving pin (28) disposed in a direction of the swash plate pivot axis, and that the intermediate member (33) includes a sleeve section (34), which extends in a longitudinal direction of the drive shaft, from a section (36) of the intermediate member (33) which carries an annular face (35) into a central recess (37) of the swash plate (26), and which contains first and second longitudinal slots (38) which run in the longitudinal direction of the drive shaft and are diametrically opposed to each other in relation to the drive shaft (27), and the driving pin (28) extends through said longitudinal slots (38), and on the intermediate member (33) or on the swash plate (26), an axially directed projection (39) is provided, which engages in a recess (40) in the swash plate (26) or in the intermediate member (33).

2. The piston pump according to claim 1, in which the intermediate member (33) is disposed on the drive shaft (27) so that the intermediate member is secured by the displacing device (41) in a respectively adjusted axial position for an adjustment of the pivot angle of the swash plate (26), wherein a position of the swash plate is changed by the displacing device (41) even when the drive shaft (27) is rotating.

3. The piston pump according to claim 2, in which the annular face (35) of the intermediate member (33) is remote from the swash plate (26), said annular face runs completely around the drive shaft (27) and is perpendicular to a longitudinal direction of the drive shaft, against which face a thrust part (43) rests, which can be moved in the longitudinal direction of the drive shaft.

4. The piston pump according to claim 2, in which between the intermediate member (33) and a thrust part (43) of the displacing device (41), a slide element (42) is provided, which is attached to the thrust part (43) of the displacing device (41).

5. The piston pump according to claim 2, in which the displacing device (41) includes an eccentric shaft (44), which runs perpendicular to the drive shaft (27) and is supported on the housing (10) that said eccentric shaft rotates around its own longitudinal axis and which, on an end oriented toward the drive shaft (27), has a continuation, which is offset relative to its longitudinal axis, and a thrust part (43) acts upon the intermediate member (33).

6. The piston pump according to claim 1, in which the intermediate member (33) is disposed on the drive shaft (27).

7. The piston pump according to claim 1, in which the annular face (35) of the intermediate member 933) is remote from the swash plate (26), said annular face runs completely around the drive shaft (27) and is perpendicular to a longitudinal direction of the drive shaft, against which face a thrust part (43) rests, which can be moved in the longitudinal direction of the drive shaft.

8. The piston pump according to claim 3, in which between the intermediate member (33) and a thrust part (43) of the displacing device (41), a slide element (42) is provided, which is attached to the thrust part (43) of the displacing device (41).

9. The piston pump according to claim 6, in which the displacing device (41) includes an eccentric shaft (44), which runs perpendicular to the drive shaft (27) and is supported on the housing (10) that said eccentric shaft rotates around its own longitudinal axis and which, on an end oriented toward the drive shaft (27), has a continuation, which is offset relative to its longitudinal axis, and a thrust part (43) acts upon the intermediate member (33).

10. The piston pump according to claim 1, in which the annular face (35) of the intermediate member (33) is remote from the swash plate (26), said annular face runs completely around the drive shaft (27) and is perpendicular to a longitudinal direction of the drive shaft, against which face a thrust part (43) rests, which can be moved in the longitudinal direction of the drive shaft.

11. The piston pump according to claim 1, in which between the intermediate member (33) and a thrust part (43) of the displacing device (41), a slide element (42) is provided, which is attached to the thrust part (43) of the displacing device (41).

12. The piston pump according to claim 1, in which the displacing device (41) includes an actuating electric motor drive (45) for actuating the intermediate member (33).

13. The piston pump according to claim 12, in which a thrust part (43) of the displacing device (41) is acted upon by the actuating electric motor drive (45) via a gear device (46).

14. The piston pump according to claim 1, in which a sensor is provided relative to the displacing device (41), said sensor measures a rotational movement of an actuating drive (45) and an output signal of said sensor is supplied to a control device, said control device acts upon the displacing device (41), wherein the sensor determines a number of rotations of the actuating drive (45).

* * * * *